US006726975B2

(12) United States Patent
Rockwell et al.

(10) Patent No.: US 6,726,975 B2
(45) Date of Patent: Apr. 27, 2004

(54) MULTIPLE FIBER FLOOR MAT AND METHOD

(75) Inventors: James N Rockwell, LaGrange, GA (US); Richard C Willey, Jr., LaGrange, GA (US); Tammy B Gooch, LaGrange, GA (US)

(73) Assignee: Milliken & Company, Spartanburg, SC (US)

( * ) Notice: Subject to any disclaimer, the term of this patent is extended or adjusted under 35 U.S.C. 154(b) by 311 days.

(21) Appl. No.: 09/888,749

(22) Filed: Jun. 25, 2001

(65) Prior Publication Data

US 2002/0092261 A1 Jul. 18, 2002

Related U.S. Application Data

(60) Provisional application No. 60/214,670, filed on Jun. 27, 2000.

(51) Int. Cl.[7] ..... D02G 1/16; D02G 3/04; D02G 3/22

(52) U.S. Cl. ..... 428/92; 428/97; 428/370; 57/350; 57/908; 28/258; 28/271

(58) Field of Search ..... 428/92, 97, 364, 428/369, 370, 399; 57/243–246, 350, 908; 28/258, 271; 15/215–217

(56) References Cited

U.S. PATENT DOCUMENTS

| | | | | |
|---|---|---|---|---|
| 1,008,618 A | | 11/1911 | Skowronski et al. | |
| 2,599,049 A | | 6/1952 | Dollinger | 15/301 |
| 3,306,808 A | | 2/1967 | Thompson et al. | 161/66 |
| 4,045,605 A | | 8/1977 | Breens et al. | 428/88 |
| 4,353,944 A | | 10/1982 | Tarui | 428/74 |
| 4,371,371 A | | 2/1983 | Smrekar | 8/531 |
| 4,711,191 A | * | 12/1987 | Schwartz | 112/410 |
| 4,741,065 A | | 5/1988 | Parkins | 15/217 |
| 4,820,566 A | | 4/1989 | Heine et al. | 428/88 |
| 4,886,692 A | | 12/1989 | Kerr et al. | 428/82 |
| 5,055,333 A | | 10/1991 | Heine et al. | 428/88 |
| 5,227,214 A | | 7/1993 | Kerr et al. | 428/95 |
| 5,240,530 A | | 8/1993 | Fink | 156/94 |
| 5,305,565 A | | 4/1994 | Nagahama et al. | 52/177 |
| 5,503,096 A | * | 4/1996 | Willey | 112/475.23 |
| 5,545,276 A | | 8/1996 | Higgins | 156/79 |
| 5,786,083 A | | 7/1998 | Harris | 428/373 |
| 5,887,416 A | | 3/1999 | Shimono et al. | 57/236 |
| 5,987,867 A | | 11/1999 | Lang et al. | 57/236 |
| 6,030,685 A | | 2/2000 | Schweighardt et al. | 428/97 |
| 6,240,609 B1 | * | 6/2001 | Rasnick et al. | 28/258 |
| 6,332,253 B1 | * | 12/2001 | Rasnick et al. | 28/258 |
| 6,401,315 B2 | * | 6/2002 | Rasnick et al. | 28/258 |
| 6,582,816 B2 | * | 6/2003 | Rasnick et al. | 428/364 |
| 6,638,614 B2 | * | 10/2003 | Rasnick et al. | 428/364 |
| 2001/0025405 A1 | * | 10/2001 | Rasnick et al. | 28/258 |
| 2002/0029554 A1 | * | 3/2002 | Belcher et al. | 57/333 |
| 2002/0032955 A1 | * | 3/2002 | Rasnick et al. | 28/103 |
| 2002/0121011 A1 | * | 9/2002 | Rasnick et al. | 28/258 |

FOREIGN PATENT DOCUMENTS

| | | |
|---|---|---|
| EP | 0 933 059 A2 | 4/1999 |
| EP | 0 965 300 A1 | 12/1999 |
| WO | 95/30040 | 11/1995 |

OTHER PUBLICATIONS

Beigel et al., Carpets and Flooring for Your Home, Quiller Press Ltd., London, (1995), Figure on p. 80.*

* cited by examiner

*Primary Examiner*—Cheryl A. Juska
(74) *Attorney, Agent, or Firm*—Terry T. Moyer; Daniel R. Alexander

(57) ABSTRACT

Dual fiber carpet and matting fabrics are made of tufted ends of yarn with one end being made from standard carpet denier yarns ranging from about 10 to 30 denier per filament and total denier ranging from about 600 to 5000 denier and the second end being made from heavy monofilament fibers with a denier per filament ranging from about 100 to 500 denier and a total denier ranging from about 300 to 5000 denier per yarn bundle. Both fibers can be made from a variety of synthetic and/or natural materials. Also, a combination of at least three floor or ground covering articles, A, B, and C, for placement in and around the entryway of a building is disclosed which provides more effective cleaning ability for pedestrians' footwear, thus better ensuring the inside of the building itself remains clean.

8 Claims, 3 Drawing Sheets

MULTIPLE FIBER FLOOR MAT AND METHOD

CROSS-REFERENCE TO RELATED APPLICATIONS

This application claims priority to and the benefit of U.S. Provisional Patent Application Ser. No. 60/214,670, filed Jun. 27, 2000, and hereby incorporated by reference.

In accordance with the present invention, dual fiber carpet and matting fabrics are comprised of tufted ends of yarn with one end being made from standard carpet denier yarns ranging from about 10 to 30 denier per filament and total denier ranging from about 600 to 5000 denier and the second end being made from heavy monofilament fibers with a denier per filament ranging from about 100 to 500 denier and a total denier ranging from about 300 to 5000 denier per yarn bundle. Both fibers can be made from a variety of synthetic and/or natural materials. For example, polymers including but not limited to nylon, polyester, acrylic, and polypropylene. Alternatively, natural fibers such as cotton, cotton blend, and/or wool may be used. These yarns are tufted together to form a dual or multiple fiber fabric and may be tufted in any combination and pattern.

This type of tufted fabric is typically used in the matting industry because of the high propensity of removing dirt and water from shoes. Mat materials are described, for example, in U.S. Pat. Nos. 4,820,566 and 5,055,333. Because of the difficulty of dyeing the monofilament fibers, dyeing must be done with either pressure jet dyeing, pad dyeing, sublimation dyeing, or transfer dyeing. Dyeing using injection dye technology has not been possible because of the inability of the monofilament fibers to absorb the dye readily in order to fill the majority of the available dye sites thereby leaving ends that are only slightly stained. Injection dye technology refers to the fabric dyeing process of applying dye to fiber with jets of dye being sprayed onto the fabric. Some types of this equipment are referred to as the Millitron dye machine by Milliken and Company and the Chromojet dyeing machine by Zimmer. Such dyeing equipment may be indirect jet, direct jet, airjet, bubble jet, ink jet, or the like.

In accordance with the present invention, dual fiber mat material is constructed in such a manner that allows dyeing with the use of injection dye technology. The fibers are constructed in such a way that the dual fiber properties remain and, at the same time, allow the monofilament fibers to absorb and adequately fill the open dye sites for complete coloration of the fiber.

The dyeing of the monofilament fibers in the dual fiber fabric using injection dyeing technology is made possible in the present yarn construction process. The monofilament fibers, which range from about 100 to 500 denier per filament, are textured together through the use of either air jet or mechanical texturing processes. The number of monofilament ends that are textured together can be comprised of from about 2 to 30 filaments. After the texturing process is complete, the monofilament end is then air entangled with one end of conventional carpet yarn which can range from about 10 to 30 denier per filament and a total denier of about 600 to 5000 per yarn bundle. The entangling of the standard carpet yarn with the monofilament ends allows the dye fired from the jets, to be held on the surface of the monofilament fibers long enough for adequate dye penetration. Surface tensions are improved to the point that very intricate and detailed patterns are possible with no shaded dyeing and with high pattern clarity.

This invention allows for precise and complex dyeing of dual or multiple fiber tufted fabrics that yields high pattern clarity and deep dye penetration using injection dyeing technology.

Specific examples of the dual fiber base that can be dyed on an injection dye range are as follows.

I. The base is made from two different ends of yarn to construct the dual fiber base. The first end is made from 9 ends of 300 denier type 6 nylon monofilament fiber that has been airjet textured together. These textured monofilament ends are then air entangled with one end of type 6,6 nylon 1230 denier 18 dpf carpet yarn. The second end is made from three ends of air entangled type 6,6 nylon 1230 denier 18 dpf. The base is then tufted using two yarns. The yarns are tufted in straight rows on a 5/32 gauge cut (or loop) pile tufter. The base is made by alternating one end of the air entangled monofilament end and three ends of the air entangled 1230 denier yarn across the total width of the fabric. The base is then dyed on an injection dye machine (Millitron) at a speed of 30 feet per minute and a firing time of 7 milliseconds.

II. A second base is made from two different ends of yarn to construct the dual fiber base. The first end is made from 9 ends of 500 denier type 6 nylon monofilament fiber that is airjet textured together. These textured monofilament ends are then air entangled with one end of type 6,6 nylon 1230 denier 30 dpf carpet yarn. The second end is made from three ends of air entangled type 6,6 nylon 1230 denier 30 dpf. The base is then tufted using the two yarns. The yarns are tufted in straight rows on a 5/32 gauge cut (or loop) pile tufter. The base is made by alternating one end of the air entangled monofilament end and three ends of the entangled 1230 denier yarn across the total width of the fabric. The base is then dyed in an injection dye machine (Millitron) at a speed of 50 feet per minute and a firing time of about 2.5–7 milliseconds.

III. A third method of constructing this base would be to use 14 ends of 20 denier type 6 nylon monofilament fiber that has been airjet textured together. The textured monofilament ends are then air entangled with one end of 4/1 cc cotton yarn. The second end is made from three ends of 4/1 cc cotton yarn air entangled together. The yarns are tufted in straight rows on a 1/8 gauge cut (or loop) pile tufter. The base is made by alternating one end of the air entangled monofilament end and three ends of the air entangled 4/1 cotton yarn across the total width of the fabric. The base is then dyed on an injection dye machine (Millitron) at a speed of 28 feet per minute and a firing time of 7 milliseconds.

IV. A fourth method of constructing this base would be to use 9 ends of a non-sulfonated solution dyed 300 denier monofilament (nylon 6 or nylon 6,6) that has been airjet textured together. These textured monofilament ends would then be air entangled with one end of 1381 denier non-sulfonated solution dyed yarn 23 dpf. The second end is made from three ends of 1381 denier non-sulfonated solution dyed yarn 23 dpf (nylon 6 or nylon 6,6), air entangled together. The yarns are tufted in straight rows on a 5/32 gauge cut (or loop) pile tufter. The base is made by alternating one end of the air entangled monofilament end and three ends of the air entangled 1381 denier solution dyed end across the total width of the fabric. The base is then dyed on an injection dye machine (Millitron) at a speed of 28 feet per minute and a firing time of 6 milliseconds.

This application is generally related to U.S. patent application Ser. No. 08/989,091, filed on Dec. 11, 1997, herein entirely incorporated by reference.

This invention finds special applicability to a combination of floor coverings arranged in and around an entryway to a building in order to provide effective moisture, dirt, and debris removal from the footwear of pedestrians entering such a building. More particularly, this combination comprises at least three floor covering articles placed inside and outside an entryway of a building and having reduced amount of coarse filament the closer to and further inside the entryway such articles are placed. An alternate arrangement involving a building having an airlock-type vestibule configuration is also provided.

Floor mats have long been utilized to facilitate the cleaning of the bottoms of people's shoes. Moisture, dirt, and debris from out of doors easily adhere to such footwear, particularly in inclement weather and particularly in areas of grass or mud or the like. Such unwanted and potentially floor staining or dirtying objects need to be removed from a person's footwear prior to entry indoors. In response, floor mats, in particular those having a tufted carpet pile comprised solely of coarse filaments, were developed which provide an easy manner of cleaning the soles of a person's shoes simply by scraping the footwear against such a stiff article. Examples of such floor mats are exemplified in U.S. Pat. No. 1,008,618, to Skowronski et al., U.S. Pat. No. 4,045,605, to Breens et al., and U.S. Pat. No. 4,353,944, to Tarui, as well as French Patent No. 1,211,755, assigned to Cosyntex (S.A.) and PCT Application 95/30040, assigned to Kleen-Tex Industries, Inc.

Further improvements over the basic all-coarse filaments mats included interspersed coarse and fine carpet pile yarns, either in stripe or checkerboard patterns, as taught by U.S. Pat. Nos. 4,820,566 and 5,055,333, both to Heine et al., or in separate regions of the same article, as in Tarui, above. One notable development is found in U.S. Pat. No. 2,599,049, to Dollinger. This reference teaches an inside vestibule mat having three separate regions of decreasing amounts of coarse filament. Also integral within this article are a heating system for drying the moisture, mud, etc., on the floor mat, and a drawing exhaust system beneath the mat for removing such dried matter from the mat without the need of displacing the mat itself. All of the aforementioned patent documents are incorporated herein by reference. Nowhere in the prior art patents is a system of three separate floor covering articles disclosed or fairly suggested which must be placed in specific locations relative to a building's entryway, which have specific amounts of coarse and/or fine carpet pile yarns, and which are removable from their respective building locations for industrial wash processing. Therefore, a need exists for such an improved, easily laundered or cleaned, effective moisture, dirt, and debris removal entry barrier combination.

It is thus an object of at least one embodiment of this invention to provide a building entry barrier combination of at least three floor or ground covering articles having decreasing degrees of coarse filament carpet pile compositions relative to each article's placement from further to nearer to within the building entryway. Furthermore, it is an object of the invention to provide a multistep entry barrier system which comprises easily removable and easily launderable floor covering articles. Still a further object of this invention is to provide a series of footwear scraping articles which more easily and more thoroughly removes moisture, dirt, and debris from a person's shoes. Yet another object of the invention is to provide an entry barrier combination of floor covering articles as noted above wherein one article is located outside an entry of a building, one is located inside an airlock-type entry vestibule but outside the main part of a building, and one article is located just inside the airlock-type entry vestibule of a building.

The term building pursuant to this invention encompasses such structures as an office building, hotel, store, apartment complex, house, and the like; basically any man-made structure which requires a relatively heavy amount of pedestrian traffic. The term entryway for this invention simply means the area of ingress and/or egress from such a building. Generally, such an area separates the inside of a building from the outside of a building through the use of a door, which can be of any type (i.e., wooden, glass, revolving, sliding, and the like). Furthermore, such a building may comprise an airlock-type vestibule which is simply an enclosed area between an outer door, which leads to the outside of the building, and an inner door, which leads to the inside of the building. Such outer and inner doors may be, again, any type or make.

The barrier combination of at least one embodiment of this invention is utilized to facilitate and effectuate the removal of moisture, dirt, and debris from the footwear of pedestrians entering such a building. This combination is arranged in the manner or manners specified below whereupon the shoe-sole cleaning ability of each separate article within this combination diminishes as a pedestrian nears and ultimately enters the building. Each separate article can easily be removed from the floor or ground and can be easily laundered through, preferably, industrial washing processes, although hand washing and any other type of cleaning may be utilized, also.

The inventive combination includes, as noted above, at least three floor or ground covering articles, A, B, and C. These articles are preferably arranged in and around a building entryway wherein the article or articles located outside the entryway have greater amounts of heavy denier coarse monofilament carpet yarns than does the article or articles located inside the entryway. In this manner, more moisture, dirt, and debris can be removed from a person's footwear as such a pedestrian is outside the building stepping on the coarser article, while residual amounts are removed by the less coarser articles leading into and located inside the building. In particular, A is a floor covering placed inside a building entryway, C is a ground covering article placed outside a building entryway, and B is either a floor covering article placed inside the entryway, but closer to the entryway than A, or B is a ground covering article placed outside the entryway, but closer to the entryway than C. Thus, C, having completely tufted pile completely comprising heavy denier coarse monofilament carpet yarn, has a higher percentage of such heavy denier coarse yarn than does B, and B has a higher percentage of such carpet yarn than does A. Preferably, B has completely tufted pile comprising, as merely an example, from about 30 to about 60% tufted heavy denier coarse monofilament carpet yarn and 40 to 70% fine denier carpet yarn, and A has completely tufted pile comprising, for example, from about 10 to about 20% heavy denier coarse carpet yarn and from about 80 to about 90% fine denier carpet yarn. Other additional floor or ground covering articles may be present as long as each additional article has a lower percentage of coarse carpet yarn in the same type of series as set forth above.

Another preferred arrangement is provided when the building entryway includes an airlock-type vestibule configuration. In such a scenario, A is placed inside the building, but not within the vestibule, B is a floor covering article placed inside the vestibule, and C is placed outside the building. In this and the aforementioned preferred arrangement, C is placed directly adjacent to, or within a reasonably close proximity of, the entryway or the outer door, such as between 0 and 6 feet. Preferably, C abuts the outer door itself (i.e., 0 feet away); however, if B is also placed outside the building, then B is preferably abuts the entryway or outer door and C is preferably placed directly adjacent to B. Of course, B may be placed as far away as 6 feet from the entryway or the outer door and C may be placed as far away as 6 feet from B, if desired. Where A is concerned, it is also placed within a reasonably close proximity to the entryway or inner door (0 to 6 feet away), and preferably abuts such an entryway; however, if B is placed inside the entryway, then it is placed within a reasonably close proximity to said inner door, preferably abutting it, and A is placed within a similar distance to B. If B is placed within an airlock-type vestibule, then it may be placed at any distance from either the inner or outer door.

A noticeable benefit of this combination is the ability for the majority of the potential moisture, dirt, and debris from pedestrians' shoes to remain, through removal by the coarser carpet yarn, outside such a building. Since the smaller, residual amounts of such liquids and/or solids would then be removed by the other less coarse mats, the chance of transferring such unwanted matter into the building are thereby reduced. The coarse fibers on each floor covering or ground article must also have the ability to retain the dirt, moisture, and debris removed from pedestrian footwear within the body of the article. In this fashion, the removed and retained matter cannot be transferred to the shoes of a subsequent pedestrian, thus preventing the potential "re-tracking" of moisture, dirt, and debris through the building. A more effective way of cleaning and scraping a pedestrian's shoes as well as ensuring the building's interior will remain clean are thus provided.

Additionally, such a system permits a more pleasing aesthetic effect within a building entryway since myriad patterns and colorations can be utilized on the aforementioned floor or ground covering articles. Furthermore, and as noted above, the floor or ground covering articles are easily removable themselves from their locations so as to be easily laundered or washed. Such a benefit facilitates the cleaning of such floor or ground coverings in order to ensure the aesthetic characteristics desired remain and allows for reduced amounts of residue to be carried by a pedestrian's footwear subsequent to traversing such articles.

The articles A, B, and C are each, in one preferred embodiment, produced in mat form having the requisite flexibility to withstand the aforementioned industrial laundering processes. Such mats are generally comprised of a tufted carpet pile attached to a vinyl, latex, or vulcanized rubber sheet as exemplified in U.S. Pat. No. 3,306,808, to Thompson et al., U.S. Pat. No. 4,741,065, to Parkins, U.S. Pat. No. 4,886,692, to Kerr et al., U.S. Pat. No. 5,227,214, to Kerr et al., U.S. Pat. No. 5,240,530, to Fink, and U.S. Pat. No. 5,305,565, to Nagahama et al., all hereby entirely incorporated by reference. Such an attachment can be accomplished during the actual vulcanization step, as taught in Nagahama, for example, above, or through the use of an adhesive layer, preferably a polyolefin adhesive, between the carpet pile and the rubber sheet, as disclosed in copending U.S. patent application Ser. No. 08/732,866, all such references herein being entirely incorporated by reference. A particularly notable reference is PCT Application No. 96/37645, to Milliken Denmark, which discloses suitable coarse fiber mat products, herein incorporated by reference.

In another preferred embodiment, B and C are produced in mat form while A is produced in broadloom form. Such a form encompasses extra-wide and long carpets, or, in other words, carpets which are regularly placed wall-to wall in hallways, rooms, and the like. Such broadloom products are manufactured on an extra-wide loom and may be colored through any standard process (i.e., jet-dyeing, immersion, spraying, etc.). Such a floor covering may be applied to a floor with an easily dissolvable adhesive to facilitate its removal therefrom. Also, and to the contrary, such carpet may be cleaned while remaining at its location through the use of any standard, well-known wet-, dry, or steam-cleaning process for carpet. These broadloom products may have backings made from polyvinyl chloride, vinyl, or urethane (which provides improved cushioning).

In yet another preferred embodiment, B and C are produced in mat form while A is produced in tile form. Such a form is exemplified in U.S. Pat. No. 5,545,276, to Higgins, entirely incorporated herein by reference. Carpet tiles of this sort are easily removable and thus can be easily cleaned at a remote location. Furthermore, such a product can be patterned or colored through any well-known process (such as jet-dyeing, etc.) in such a way as to provide a tile or group of tiles which is or are both integral aesthetically to and functionally with the remaining tiles of the particular room, hall, foyer, etc. The preferred embodiment contemplates a single large tile or a group of tiles which appear and match the same pattern as the other carpet tiles but include the requisite amount of heavy denier coarse monofilament carpet yarn while the remaining tiles do not comprise such a heavy denier component. Furthermore, such tile products may have backings made from polyvinyl chloride, vinyl, or urethane (which provides improved cushioning).

Each of the articles A, B, and C can be of any standard size for mats, and A may be of any standard size for broadloom or tile products. More succinctly, if the article is a mat, any size from roughly 2 feet by 2 feet to about 4 feet by 8 feet is preferred. Larger and smaller sizes are also contemplated. If A is a broadloom product, preferably it is of a size from about 2 feet by 3 feet to about 6 feet by 10 feet. Again, other sizes, both larger and smaller are possible. If A is a tile product, each individual tile, from about 18 inches by 18 inches to about 36 inches by 36 inches, may comprise the entire article contemplated. However, groupings of such tiles may be utilized also. For instance, a configuration of 2 tiles in three rows (72 inches by 108 inches) may comprise article A. Generally, the largest grouping of tiles would equal an area total of about 108 inches by 180 inches; smaller areas of tile groupings are thus also contemplated within this invention.

The term denier, as it applies to yarns, refers to the weight of a fiber having a length of 9,000 meters. Heavy, coarse fibers generally have a range of deniers from about 100 to about 5,000 denier per filament ("dpf"). The preferred range is from about 100 to about 2,000 dpf, and most preferred is a range of from about 150 to about 1,000 dpf. Fine fibers generally have a range of deniers from about 0.1 to about 100 dpf, preferably from about 1 to about 50 dpf, and most preferred from about 5 to about 50 dpf. The actual yarns utilized within this invention for each of the articles A, B, and C are completely tufted on the carpet pile.

The specific heavy denier coarse monofilament carpet yarns may be made from polypropylene, polyester, nylon 6, nylon 6,6, or any combinations thereof. Preferably, such yarns are made of nylon 6. Such coarse fibers may be formed either of single component filaments or of two-component sheath/core filaments having a core of one material enclosed within a sheath of a second material. The core may be formed of a single filament or of a filamentous yarn and may be coated with thermoplastic materials, such as polyvinyl chloride. The specific fine denier carpet yarns may be made from nylon 6, nylon 6,6, acrylic, regenerated cellulose, wool, polyester, cotton, propylene, or any combinations thereof. Preferred are polyester, nylon 6, nylon 6,6, or combinations thereof. Both the coarse and fine fibers may be tufted and attached to a carpet backing in any conventional manner, such as those noted in the aforementioned, therein incorporated U.S. Patents to Heine et al. and Higgins et al., and therein incorporated PCT Applications to Kleen-Tex Industries, Inc. and Milliken Denmark.

For articles A and B, the configuration of fine and coarse fibers may be arranged in any pattern. Preferably, such patterns are striped (i.e., one line of coarse fibers running longitudinally from one end of an article to the other end followed by a line of fine fibers following suit, with a repeated pattern of coarse and fine fiber lines). Other preferable and possible patterns include checkerboard, diamond-shapes, and the like; basically, and again, any possible pattern is contemplated as long as the requisite degree of coarseness is retained for each of articles A and B.

While the invention will be described and disclosed in connection with certain preferred embodiments and procedures, it is by no means intended to limit the invention to such specific embodiments and procedures. Rather, it is intended to cover all such alternative embodiments, procedures, and modification thereto as may fall within the true spirit and scope of the invention as defined and limited only by the appended claims.

Figure 1:
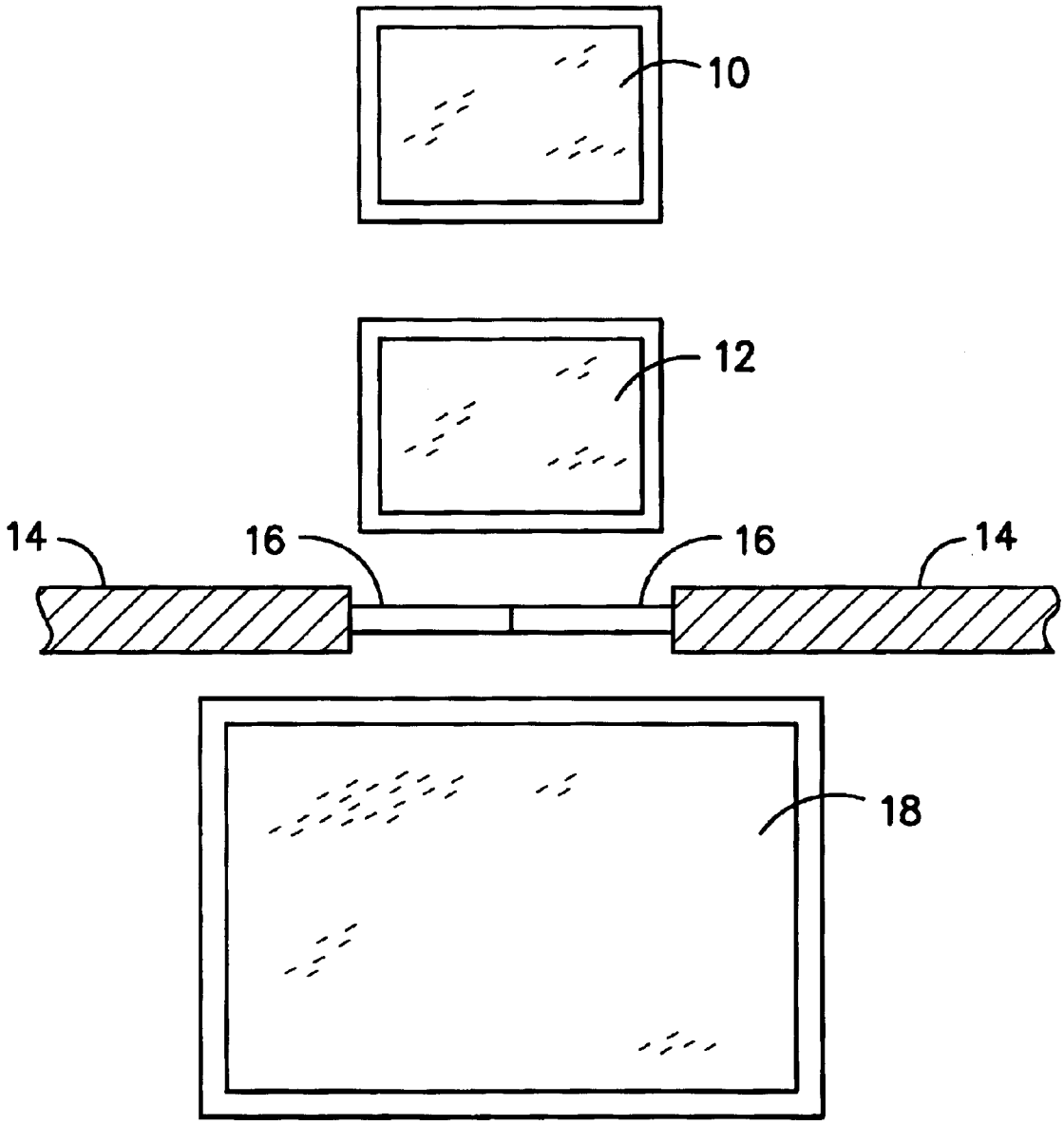
FIG. 1 is an aerial view of the inventive barrier combination wherein B is located outside the building entryway.

In FIG. 1, a building entryway is shown wherein there is a door 16 and a wall 14, both of which separate the exterior from the interior of a building (not illustrated). A floor mat 10 (which is article C, above), which comprises 100% tufted heavy denier coarse monofilament carpet yarn (propylene with denier of about 150 dpf), is placed outside the building entryway at a location about 4 feet from the door 16, further from the door 16 and wall 14 than is floor mat 12 (article B, above), which comprises about 50% heavy denier coarse monofilament carpet yarn (polypropylene with denier of about 150 dpf) and about 50% fine denier carpet yarn (nylon 6,6 with denier of about 1). Article C 10 is thus located about 1 foot from article B 12, which is about 1 foot from the door 16. Floor mat 18 (article A, above) which comprises about 10% heavy denier coarse monofilament carpet yarn (polypropylene with denier of about 150 dpf) and about 90% fine denier carpet yarn (nylon 6,6 with denier of about 1), is located within the building entryway, about 1 foot from the door 16. All of mats 10, 12, and 18 are rectangular in shape with mats 10 and 12 having areas of about 2 feet by 3 feet. Mat 18 has a size of about 6 feet by 9 feet.

Figure 2:
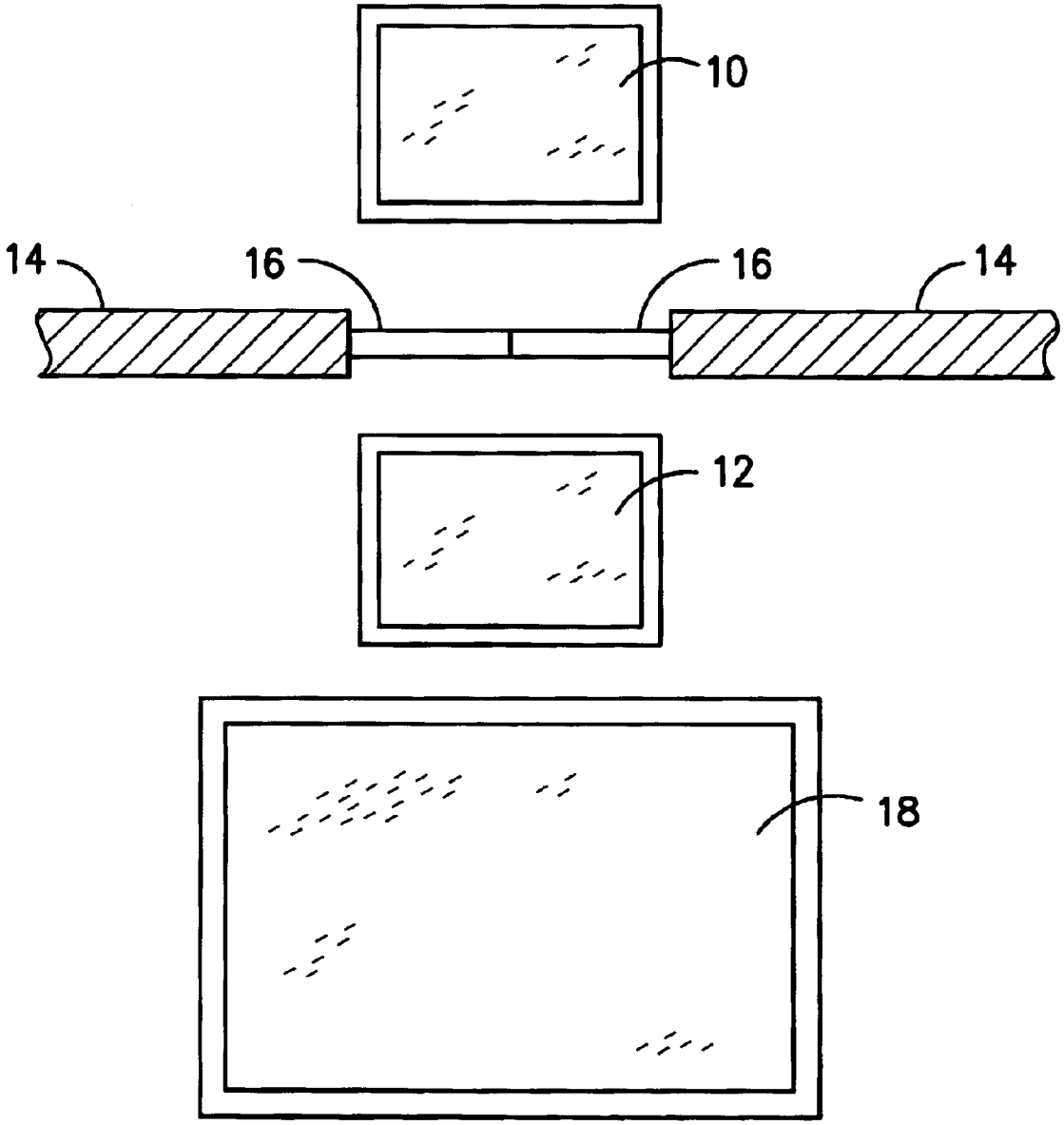
FIG. 2 is an aerial view of the inventive barrier combination wherein B is located within the building entryway.

As illustrated in FIG. 2, the mats 10, 12, and 18, having the same dimensions as in FIG. 1, above, are arranged in a configuration wherein mat 12 is located inside the building entryway, about 1 foot from the door 16, at a location closer to the door 16 and wall 14 than mat 18, which is about 4 feet from the door 16 and 1 foot from article B 12.

Figure 3:
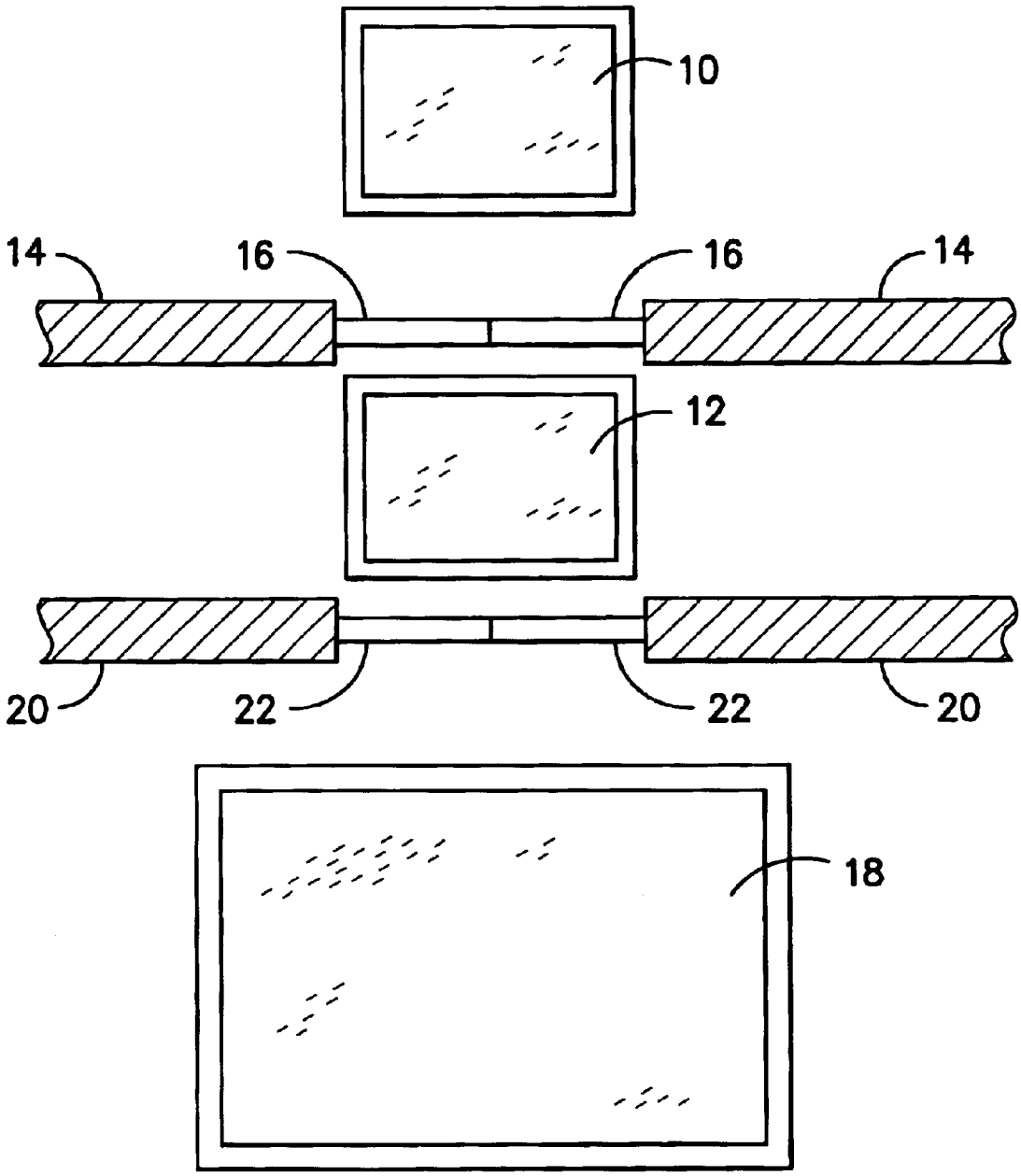
FIG. 3 is an aerial view of the inventive barrier combination wherein B is located within an airlock-type vestibule.

An airlock-type vestibule configuration is illustrated in FIG. 3 wherein article B 12 is located inside a door 16 and a wall 14 but outside another door 22 and another wall 20. Article B 12 is thus about 6 inches from the outside door 16 and about 6 inches from the inside door 22. All of mats 10, 12, and 18 have the same dimensions as for FIGS. 1 and 2, above. Article C 10 remains at a location outside of the building entryway, about 1 foot away from the door 16, and article A 18 remains at a location inside of the building entryway, at a location further inside the building than the airlock-type vestibule formed by doors 16 and 22 and walls 14 and 20, about 1 foot from the door 22.

The multiple fiber material of one embodiment of the present invention may be a nonwoven material which contains a carpet yarn and a monofilament yarn.

It is, of course, to be appreciated that while several potentially preferred embodiments have been shown and described, the invention is in no way to be limited thereto, since modification may be made and other embodiments of the principles of this invention will occur to those skilled in the art to which this invention pertain. Therefore, it is contemplated by the appended claims to cover any such modifications and other embodiments as incorporate the features of this invention within the true spirit and scope thereof.

What we claim is:

1. A dual fiber base comprising two different ends of yarn, the first end is made from 9 ends of 300 denier type 6 nylon monofilament fiber airjet textured together, these textured monofilament ends are air entangled with one end of type 6,6 nylon 1230 denier 18 dpf carpet yarn, the second end is made from three ends of air entangled type 6,6 nylon 1230 denier 18 dpf, the base is then tufted using the two yarns, the yarns are tufted in straight rows on a 5/32 gauge cut pile tufter, the base is made by alternating one end of the air entangled monofilament end and three ends of the air entangled 1230 denier yarn across the total width of the fabric, the base can be dyed on an injection dye machine.

2. A dual fiber base comprising two different ends of yarn, the first end is made from 9 ends of 500 denier type 6 nylon monofilament fiber that is airjet textured together, these textured monofilament ends are air entangled with one end of type 6,6 nylon 1230 denier 30 dpf carpet yarn, the second end is made from three ends of air entangled type 6,6 nylon 1230 denier 30 dpf, the base is then tufted using the two yarns, the yarns are tufted in straight rows on a 5/32 gauge cut pile tufter, the base is made by alternating one end of the air entangled monofilament end and three ends of the entangled 1230 denier yarn across the total width of the fabric, the base can be dyed in an injection dye machine.

3. A dual fiber base comprising two different ends of yarn, the first end is made from 14 ends of 20 denier type 6 nylon monofilament fiber that has been airjet textured together, the textured monofilament ends are air entangled with one end of 4/1 cc cotton yarn, the second end is made from three ends of 4/1 cc cotton yarn air entangled together, the yarns are tufted in straight rows on a 1/8 gauge cut pile tufter, the base is made by alternating one end of the air entangled monofilament end and three ends of the air entangled 4/1 cotton yarn across the total width of the fabric, the base can be dyed on an injection dye machine.

4. A dual fiber base comprising two different ends of yarn, the first end is made from 9 ends of a non-sulfonated solution dyed 300 denier monofilament (nylon 6 or nylon 6,6) that has been airjet textured together, these textured monofilament ends are air entangled with one end of 1381 denier non-sulfonated solution dyed yarn 23 dpf, the second end is made from three ends of 1382 denier non-sulfonated solution dyed yarn 23 dpf (nylon 6 or nylon 6,6), air entangled together, the yarns are tufted in straight rows on a 5/32 gauge cut pile tufter, the base is made by alternating one end of the air entangled monofilament end and three ends of the air entangled 1381 denier solution dyed end across the total width of the fabric.

5. A method of constructing a dual fiber mat material comprising the steps of texturing together about 2 to 30 monofilament fibers, which range from about 100 to 500 denier per filament, through the use of either air jet or mechanical texturing processes, to form a monofilament end and after the texturing process is complete, entangling the monofilament end with one end of conventional carpet yarn which can range from about 10 to 30 denier per filament and a total denier of about 600 to 5000 per yarn bundle.

6. A dual fiber mat material made by the process of claim 5.

7. A mat containing the dual fiber mat material made by the process of claim 5.

8. A dyed mat containing the dual fiber mat material made by the process of claim 5.

* * * * *

UNITED STATES PATENT AND TRADEMARK OFFICE

CERTIFICATE OF CORRECTION

PATENT NO. : 6,726,975 B2 
DATED : April 27, 2004
INVENTOR(S) : James N. Rockwell, Richard C. Willey, Jr. and Tammy B. Gooch It is certified that error appears in the above-identified patent and that said Letters Patent is hereby corrected as shown below:

Column 8,
Line 59, after the word "of" delete "1382" and insert -- 1381 --.

Signed and Sealed this

Seventh Day of December, 2004

JON W. DUDAS
*Director of the United States Patent and Trademark Office*